US005865432A

United States Patent [19]

Lee

[11] Patent Number: 5,865,432

[45] Date of Patent: Feb. 2, 1999

[54] DEVICE FOR ELIMINATING JAMMED PAPERS

[75] Inventor: Jae-Sung Lee, Suwon, Rep. of Korea

[73] Assignee: SamSung Electronics Co., Ltd., Suwon, Rep. of Korea

[21] Appl. No.: 801,601

[22] Filed: Feb. 13, 1997

[30] Foreign Application Priority Data

Feb. 13, 1996 [KR] Rep. of Korea ..... 1996 2162

[51] Int. Cl.[6] ..... B65H 5/06

[52] U.S. Cl. ..... 271/274; 271/273

[58] Field of Search ..... 271/121, 124, 271/125, 161, 273, 274, 264

[56] References Cited

U.S. PATENT DOCUMENTS

| | | | |
|---|---|---|---|
| 1,385,930 | 7/1921 | Scott . | |
| 1,578,330 | 3/1926 | Lipton et al. . | |
| 2,208,043 | 7/1940 | Ormond . | |
| 2,974,952 | 3/1961 | Zeuthen | 271/273 |
| 3,241,665 | 3/1966 | Erk | 271/273 |
| 3,298,682 | 1/1967 | Gatti . | |
| 4,145,181 | 3/1979 | Edwards et al. . | |
| 4,522,520 | 6/1985 | Takenoya et al. . | |
| 4,583,726 | 4/1986 | Nogi et al. | 271/274 |
| 4,588,182 | 5/1986 | Nakanishi | 271/121 |
| 4,630,815 | 12/1986 | Peterson et al. | 271/273 |
| 4,903,954 | 2/1990 | Robertoson et al. . | |
| 4,973,039 | 11/1990 | Jeske et al. . | |
| 5,011,129 | 4/1991 | Holbrook . | |
| 5,182,861 | 2/1993 | Suzuki et al. . | |
| 5,488,467 | 1/1996 | Marentes et al. . | |
| 5,564,687 | 10/1996 | Heiler et al. . | |

FOREIGN PATENT DOCUMENTS

| | | | |
|---|---|---|---|
| 403162344 A | 7/1991 | Japan | 271/273 |

*Primary Examiner*—H. Grant Skaggs
*Attorney, Agent, or Firm*—Robert E. Bushnell, Esq.

[57] ABSTRACT

A device for smoothly eliminating jammed papers by the operation of a control lever in an ink-jet printer, for example, where a number of the papers are conveyed one by one from a feed cassette to a printer head, the device being installed so as to be interlocked with a paper guide member rotatably centered around a hinge axis and including a control lever and a shaft disposed in a unitary format, the operation of the lever eliminating the jammed papers caused upon the papers passing from the feed cassette to a feed roller opposing a friction roller via a paper feed path by enlarging a space between the friction roller and the feed roller.

9 Claims, 3 Drawing Sheets

DEVICE FOR ELIMINATING JAMMED PAPERS

CLAIM OF PRIORITY

This application make reference to, incorporates the same herein, and claims all benefits accruing under 35 U.S.C §119 from an application entitled Device For Eliminating Jammed Paper earlier filed in the Korean Industrial Property Office on the 13$^{th}$ day of February 1996, and there assigned Ser. No. 96-2162.

BACKGROUND OF THE INVENTION

1. Field of the Invention

The present invention relates generally to a device for eliminating jammed papers in an ink-jet printer, for example. More particularly, it relates to a device for smoothly eliminating jammed papers which are generated when papers are fed one by one between a friction roller and a feed roller in a feed cassette loaded with a plurality of papers.

2. Description of the Related Art

In general, the paper feeding structure of an ink-jet printer, for example, can be divided into two types as follows. In one printer structure, a feed cassette (automatic paper feeding device) is slopingly installed at the rear of the printer body (housing) and papers are fed one by one by feed rollers (a friction roller and a feed roller) from the feed cassette loaded with a plurality of papers to a printer head, so that the papers can be ejected into a tray after printing. In the other printer structure, the feed cassette loaded with a plurality of papers is located at the bottom of the ink-jet printer. Individual cut sheets of paper are then conveyed by a pick-up roller and the feed roller and the direction of ejection can be controlled by a guide, so that the papers are fed through the feed roller, conveyed to the printer head, and ejected after printing, in a sequential manner.

In one contemporary design for an ink-jet printer having the first of the two above-noted structures, because the friction roller and the feed roller are closely engaged with each other to convey the sheets of paper, when a sheet of the paper becomes jammed during conveyance, operational problems necessarily occur because the printer must be taken out of operation while jammed paper is removed. Moreover, when the body of the printer is roughly handled or otherwise abused during removal of the jammed paper, a malfunction of the printer frequently occurs.

Examples of early efforts in the art include U.S. Pat. No. 1,385,930 to Scott entitled Sack Feeder, which shows a roller connected to a hinge arrangement to allow the roller to be separated from a facing roller; U.S. Pat. No. 1,578,330 to Lipton, et al. entitled Feeding Mechanism for Printing Presses; and U.S. Pat. No. 2,208,043 to Ormond entitled Offset Printing Machine. Subsequent efforts, namely U.S. Pat. No. 3,298,682 to Gatti entitled Document Aligning And Feeding Device, uses a hinged arm having a roller attached to one end and including a spring, which has its height controlled by a D-shaped cam; U.S. Pat. No. 4,145,181 to Edwards, et al. entitled Apparatus To Facilitate Jam Recovery And Hot Roll Reversal In A Fusing Assembly, which has a multi-lever mechanism arranged to separate rollers and thereby facilitate removal of a paper jam; U.S. Pat. No. 4,522,520 to Takenoya, et al. entitled Device For Adjusting Printing Paper Tension In a Printer, which shows a multi-lever and hinged arm linkage for adjusting the spacing between two rollers; U.S. Pat. No. 4,630,815 to Petersen, et al. entitled Quick Releasing, Pinch Roller Mechanism, which illustrates a quick release mechanism having a lever with a cam mounted is used with a hinged arm arrangement to separate rollers in an effort to remove sheets of paper; U.S. Pat. No. 4,903,954 to Robertson, et al. entitled Sheet Transporting Apparatus; and U.S. Pat. No. 4,973,039 to Jeske, et al. entitled Device For Retailing Sheet Stacks.

More recent efforts, U.S. Pat. No. 5,488,467 to Marentes, et al. entitled Laser Printer Paper Handling System, illustrates another arrangement in which a hinged arm is controlled by a cam so as to move one roller relative to another roller; while U.S. Pat. No. 5,182,861 to Suzuki, et al. entitled Sheet-Driven Type Automatic Drafting Machine, shows a hinged arm and a cam arranged to vary the position of one roller with respect to another roller; and U.S. Pat. No. 5,011,129 to Holbrook entitled Jam Clearance Apparatus For Sheet Feeding Device, illustrates a lever connected to a plurality of hinged arms to allow the separation of rollers to facilitate clearing the apparatus of paper jams. Another recent design, U.S. Pat. No. 5,564,687 to Heiler, et al. entitled Device For Extemporaneously Raising A Transport Roller In A Feeder Of A Sheet Processing Machine, has a hand lever directly rotating the bearing shell that supports a synchronizing roller. I have found that typically these designs employ multiple linked components in an endeavor motivated by different concerns, to simply separate a pair of rollers propelling the printed medium along its path through the device

SUMMARY OF THE INVENTION

It is therefore, an object of the present invention to provide an improved process and ejection device for eliminating the jammed paper from image forming devices.

It is another object to provide a process and ejection device providing a control lever capable of enlarging the space between a friction roller and a feed roller in an image forming device.

It is yet another object to provide a process and ejection device providing a control lever capable of enlarging the space between a friction roller and a feed roller positioned at the downstream end of an elbow of a guide along the path of conveyance of a printable medium through an image forming device.

It is still another object to provide a process and ejection device able to smoothly enlarge the space along a path of conveyance between a friction roller and feed roller of an image forming device.

It is still yet another object to provide a simplified process and ejection device able to conveniently increase the access to a path of conveyance adjacent to and between a friction roller and feed roller in an image forming device.

To accomplish these and other objects, the present invention is provided with the ejection device for eliminating the jammed papers in a paper handling device of an image forming device such as an ink-jet printer, for example, wherein a number of the papers are conveyed one by one from a feed cassette to a printer head via a guiding elbow, and the ejection device is installed so as to cooperate with a paper guide member forming the elbow. The guide member is rotatably centered around a hinge axis while including a control lever and a shaft in as a unitary structure uniformly rotating in response to depression of the control lever, thereby moving the friction and feed rollers apart while simultaneously forcing the distal end of the elbow to open and increase the amount of access to the path of conveyance. This allows elimination of the jammed papers caused upon feeding the papers from the feed cassette to a feed roller opposing a friction roller via a paper feed path by enlarging a space between the feed roller and the friction roller.

BRIEF DESCRIPTION OF THE DRAWINGS

Further objects and advantages of the invention can be more fully understood from the following detailed description taken in conjunction with the accompanying drawings in which:

FIG. 3A shows the device before operation and FIG. 3B shows the device after operation.

DETAILED DESCRIPTION OF THE PREFERRED EMBODIMENTS

Figure 1:
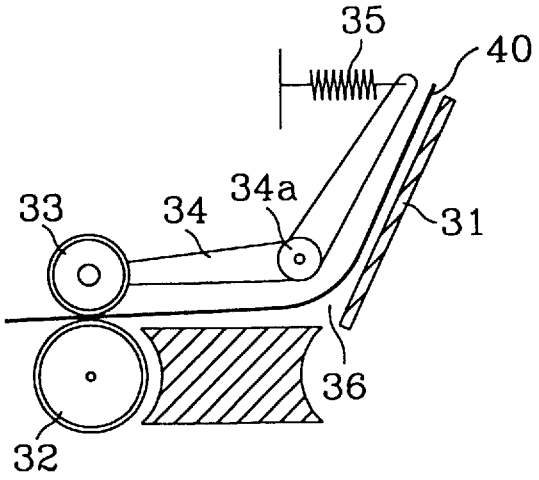
FIG. 1 (Prior Art)
FIG. 1 is a schematic side view illustrating process of conveying the papers in an earlier ink-jet printer.
Figure 2:
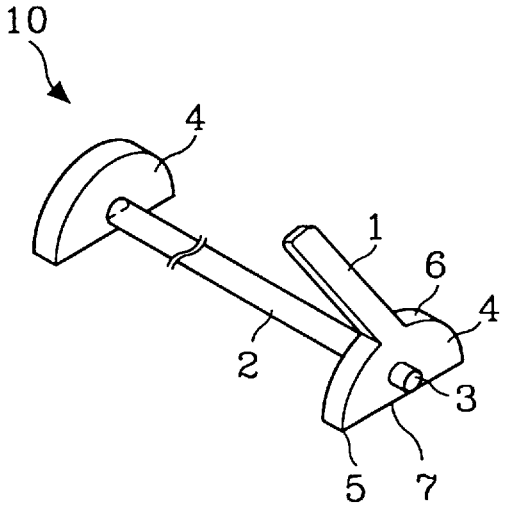
FIG. 2 is a perspective view illustrating a device for eliminating jammed papers according to a preferred embodiment of present invention.

Turning now to the drawings, as illustrated in FIG. 1, the papers 40 are conveyed one by one from the feed cassette loaded with a plurality of papers and are transferred to the print head by the friction roller 33 and the feed roller 32 via a paper feeding path 36. The print head, mounted within a carriage disposed on a shaft, prints on the papers fed one by one while enabling the shaft to be moved right and left. Then, the papers are conveyed to the ejector by the feed roller 32 and loaded into a discharging stand.

When the papers 40 are fed through the paper feeding path 36, a rotatable paper guide member 34, installed centering around a hinge axis, feeds the papers 40 to the printer head. The friction roller 33 is mounted on one end of the paper guide member 34 and a coil spring 35 is mounted on the other end thereof, wherein the paper 40 passing between the friction roller 33 and the feed roller 32 are supported securely by the elasticity of the coil spring 35.

Individual cut sheets of a printable media such as paper 40 are conveyed to the printer head by the friction between the surface of the papers 40 and the rubber of the friction roller 33; friction roller 33 is rubber coated. Additionally, a number of friction rollers 33 are provided at regular intervals and are engaged with the feed rollers 32. Thus, the friction rollers 33 transfer the papers 40.

I have found however, that because the friction roller 33 and the feed roller 32 are closely engaged with each other to convey the papers 40, when the papers are jammed during their conveyance, there are problems in that the jammed papers must be eliminated. Moreover, when the body of the printer is forcefully moved to eliminate the jammed papers, a malfunction of the printer may frequently occur.

A preferred embodiment of the present invention will be discussed in detail with reference to the accompanying drawings. As illustrated in FIGS. 2, 3A, 3B and 4, a device 10 for eliminating jammed papers generated upon a number of papers 40 being fed from a feed cassette 31 to the feed roller 32 via a paper feeding path 36 and a friction roller 33 according to the present invention, is installed to cooperatively operate with a paper guide member 34 rotatably centered around the hinge axis 34*a* while including a control level 1 and a shaft 2 in a unitary format. Guide member has an upper arm 34*b* forms the upstream entrance of a path of conveyance of a printable medium such as a cut sheet of paper 40, and a lower arm 34*c* forms the downstream length of the elbow.

The device 10 for eliminating the jammed papers according to the present invention is disposed on an upper portion of the paper guide member 34 which has one end coupled with the friction roller 33 and has a force applied thereto by a coil spring 35. A section of the shaft 2 of the device 10 is "D" shaped and both sections 4 of the shaft 2 are also "D" shaped. Additionally, the upper portion 6 of both sections 4 is of a semicircular shape and the bottom portion 7 thereof is formed so as to be flat. Also, fixing rib 3 protrudes from both sections 4 of the shaft 2, so that the is device 10 is installed to be rotatable in the printer.

Figure 3A:
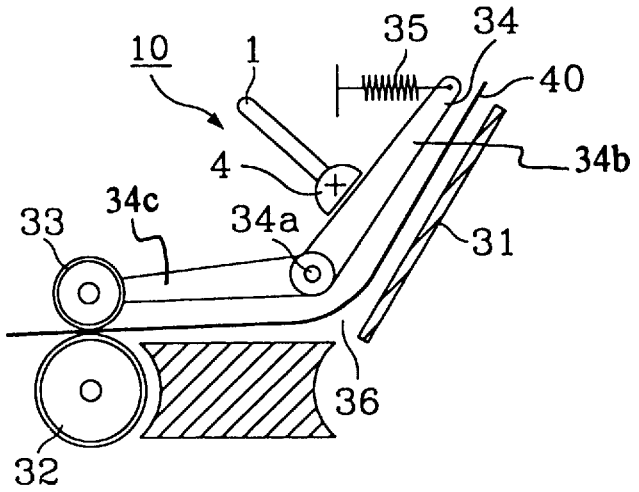
FIG. 3A and 3B are schematic side views illustrating a device for eliminating the jammed papers in an ink-jet printer according to a preferred embodiment of the present invention, where
Figure 3B:
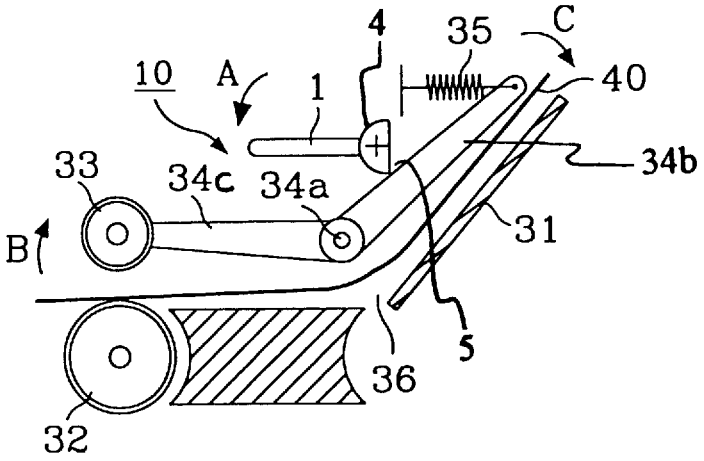
Figure 4:
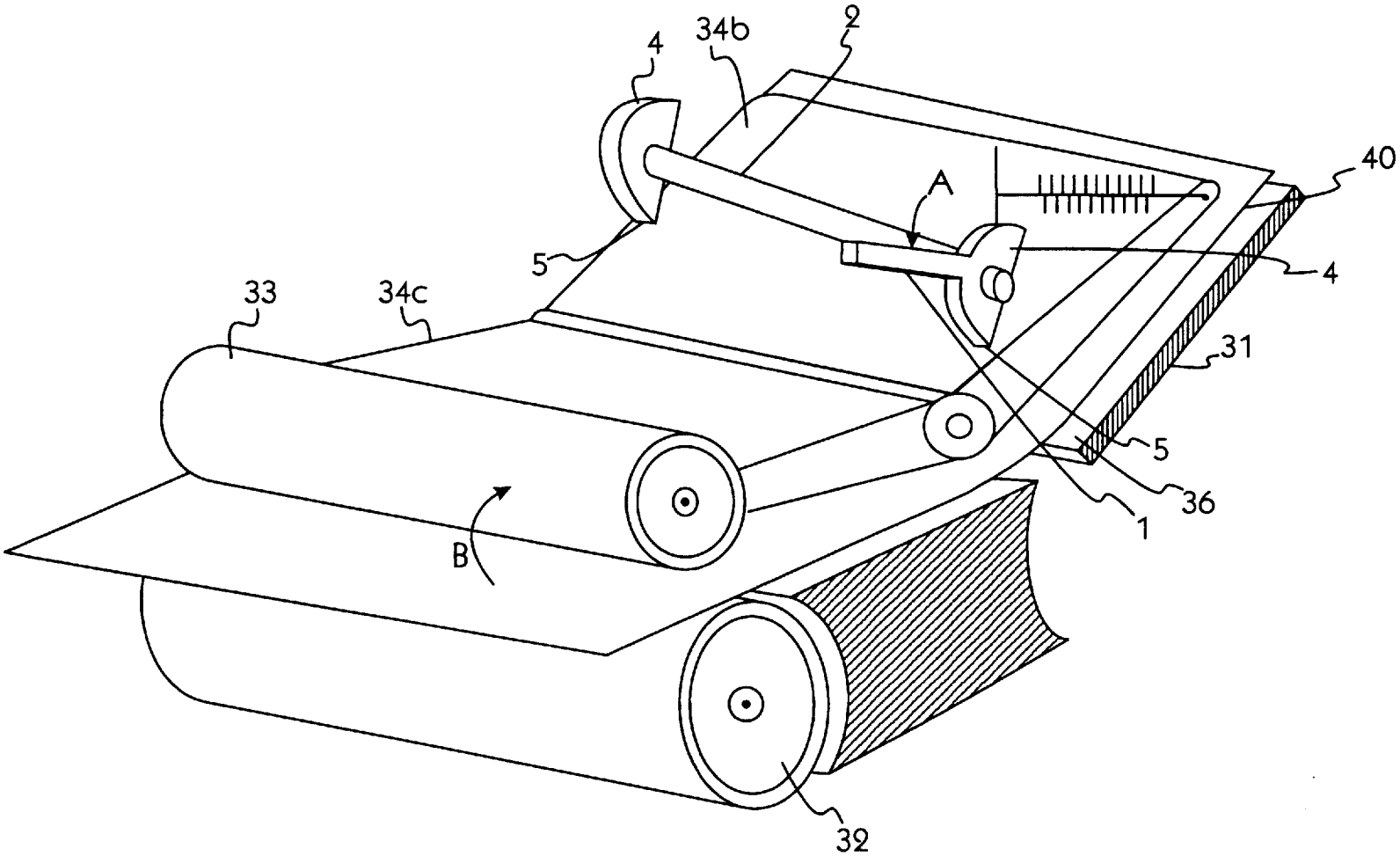
FIG. 4 is a prospective view showing one embodiment of the device while in the operational state shown in FIG. 3B.

As illustrated in FIGS. 3A, 3B and 4, the device 10 is installed to move the paper guide member 34, and the papers 40 are conveyed one by one from the feed cassette 31 loaded with a plurality of papers. Additionally, the papers 40 passing through the paper feeding path 36 pass between the friction roller 33 and the feed roller 32 and the roller 33 and 32 are interlocked with each other. When the papers 40 are jammed, the user rotates the control lever 1 counterclockwise (in a direction A) with a given force. While pushing edge 5 of sections 4 forms a camming surface that forces paper guide member 34 in one direction. Edges 5 of both sections 4 are connected to the shaft 2 slides on the upper portion of the paper guide member 34 by the rotation of the control lever 1. Thus, upward end 34*b* of the paper guide member 34 rotates around hinge axis 34*a* rotates clockwise (in a direction C) and friction roller 33 coupled with the the downstream, or lower, end 34*c* of the paper guide member 34 moves in a direction of B. Accordingly, the space between the rollers 32 and 33 is enlarged. For that reason, when the papers 40 are jammed during a printing process, the user can easily eliminate the jammed papers.

After eliminating the jammed papers, the user turns the control lever 1 clockwise. Then, the paper guide member 34 is again counterclockwise rotated by the force of the coil spring 35, and the friction roller 33 is closely engaged with the feed roller 32 to pass the papers 40. Accordingly, the papers 40 are conveyed to the printer head by the friction between the friction roller 33 and the papers 40.

As apparent from the foregoing, the device for eliminating the jammed papers in an ink-jet printer, for example, according to the present invention has an advantage in that the jammed paper can be easily eliminated by operation of the control lever.

While the present invention describes a particular embodiment above, various modifications are possible within the scope of the present invention. While the present invention has been applied to feeding papers in an ink-jet printer, the present invention can be also applied to other devices requiring paper handling. Therefore, the present invention should be not limited to the preferred embodiment described but rather is defined by the appended claims as well as their equivalents.

What is claimed is:

1. A device for eliminating jammed sheets of a printable medium, comprising:

a path conveying discrete sheets of the printable medium serially from a cassette to another location;

a guide disposed to interact with the sheets of the printable medium as those sheets travel along said path, said guide being rotatably centered around a hinge axis;

a device cooperatively engaging said guide and including a control lever and a shaft having two end sections respectively affixed to ends of said shaft disposed in a unitary format, the operation of the lever eliminating jammed sheets caused upon said sheets of the printable medium passing from said cassette to a feed roller opposing a friction roller via a sheet feed path by enlarging a space between said friction roller and said feed roller via a camming action between said two end sections of said shaft and said guide causing a rotation of said guide around said hinge axis.

2. The device as claimed in claim 1, a cross-sectional shape of said two end sections of said shaft being "D" shaped.

3. The device as claimed in claim 1, said jammed sheets being eliminated by sliding an edge of said two end sections of said shaft on a portion of said guide upon rotating said control lever with a given force.

4. A device for eliminating jammed papers in an ink-jet printer where a number of papers are conveyed one by one from a feed cassette to a printer head, said device being installed to be interlocked with a paper guide member rotatably centered around a hinge axis and including a control lever and a shaft having two end sections respectively affixed to ends of said shaft, said control lever and said shaft being disposed in a unitary format, the operation of the lever eliminating jammed papers caused upon said papers passing from said feed cassette to a feed roller opposing a friction roller via a paper feed path by enlarging a space between said friction roller and said feed roller via a camming action between said two end sections of said shaft and said paper guide member causing a rotation of said paper guide member around said hinge axis.

5. The device as claimed in claim 4, a cross-sectional shape of said two end sections of said shaft being "D" shaped.

6. The device as claimed in claim 4, said jammed papers being eliminated by sliding an edge of said two end sections of said shaft on a portion of said paper guide member upon rotating said control lever with a given force.

7. A sheet material conveyer, comprising:

a feed cassette having a capacity for storing a plurality of sheets of a printable medium;

a friction roller disposed on one end of a sheet guide member rotatably centered around a hinge axis;

a feed roller disposed opposite said friction roller;

a elastic member disposed on another end of said sheet guide member to position said friction roller to be immediately adjacent said feed roller, while a space between said friction roller and said feed roller forming a sheet conveying path with said friction and feed rollers causing said plurality of sheets to be conveyed one by one from said feed cassette; and a device for enabling elimination of jammed sheets, said device being installed to be interlocked with said sheet guide member and including a control lever and a shaft having two end sections respectively affixed to ends of said shaft, said control lever and said shaft being disposed in a unitary format, the operation of the lever eliminating jammed sheets caused upon said sheets passing from said feed cassette to said feed roller opposing said friction roller via said sheet conveying path by enlarging said space between said friction roller and said feed roller via a camming action between said two end sections of said shaft and said shaft guide member causing a rotation of said shaft guide member around said hinge axis.

8. The sheet material conveyer as claimed in claim 7, a cross-sectional shape of said two end sections of said shaft being D-shaped.

9. The sheet material conveyer as claimed in claim 7, further comprised of said jammed sheets being eliminated by sliding an edge of said two end sections of said shaft on a portion of said sheet guide member upon rotating said control lever with a given force.

* * * * *